United States Patent [19]

Kalen

[11] 3,930,294

[45] Jan. 6, 1976

[54] CYLINDRICAL SURFACE FINISHING DEVICE

[75] Inventor: Stuart E. Kalen, Sterling Heights, Mich.

[73] Assignee: Cogsdill Tool Products, Inc., Farmington, Mich.

[22] Filed: Jan. 24, 1975

[21] Appl. No.: 543,970

[52] U.S. Cl. ..... 29/90 R
[51] Int. Cl.[2] ..... B24B 39/00
[58] Field of Search ..... 29/90 R

[56] References Cited

UNITED STATES PATENTS

| | | | |
|---|---|---|---|
| 2,874,452 | 2/1959 | Thompson | 29/90 R |
| 3,626,560 | 12/1971 | Kalen | 29/90 R |
| 3,656,333 | 4/1972 | Kruse, Jr. | 29/90 R |
| 3,736,633 | 6/1973 | Kalen | 29/90 R |
| 3,751,781 | 8/1973 | Koppelmann | 29/90 R |

*Primary Examiner*—Harrison L. Hinson
*Attorney, Agent, or Firm*—Harness, Dickey & Pierce

[57] ABSTRACT

Burnishing tools are constructed for operating on internal and external cylindrical surfaces of substantial length to produce a compacted finished surface thereon. The burnishing tool has a mandrel with a truncated conical surface on which truncated conical rollers rotate as the tool is driven in rotation relative to the workpiece. By axially moving the mandrel and cage relative to each other the contraction and expansion of the rollers occurs. The rollers are retracted when the workpiece is to be removed therefrom or applied thereto and are expanded under a predetermined pressure into engagement with the workpiece for producing the burnishing operation under substantial pressure. The machine herein illustrated is self-contained having a pulley driven in rotation by an adjacently supported motor for rotating the burnishing tool while permitting the expansion and retraction of the rollers.

10 Claims, 4 Drawing Figures

CYLINDRICAL SURFACE FINISHING DEVICE

BACKGROUND OF THE INVENTION

Reference may be had to the patents to S. E. Kalen, U.S. Pat. Nos. 3,626,560; 3,736,633 and that to C. A. Kruse, Jr., U.S. Pat. No. 3,656,333 and the references cited therein for a disclosure of the pertinent prior art.

SUMMARY OF THE INVENTION

A vertically disposed plate supports a housing in which a pair of roller bearings support a spindle with a burnishing head at one end and a pulley at the other end for rotation. The pulley is recessed to overhang one of the bearings to produce a compact device and is sealed by a circular plate having interrelated circular flanges disposed closely adjacent to each other. The bearings support a sleeve which is driven in rotation by the pulley and is connected to a mandrel having an outer or inner truncated conical surface. A cage is employed in combination with the mandrel having conical rollers therein which when engaging the conical surface of the mandrel has the outer engaging lines of the rollers falling on a cylindrical surface. A cylinder is mounted on the opposite end of the rotatable sleeve to that supporting the mandrel having a piston therein connected to the mandrel or the cage to produce a relative movement thereto which retracts and expands the rollers. When a workpiece is to have the internal surface burnished, the end is placed over the cage and rollers, the air is admitted to the cylinder to move the piston under a predetermined pressure to expand the rollers into engagement with the surface as the mandrel and cage are driven in rotation to produce the burnishing operation under a predetermined pressure. The same occurs to a rod or pipe which is to have its exterior surface finished by having the rod or pipe inserted into the mandrel and cage and have the rollers expanded under the pressure of air against the exterior surface to be finished so that a burnishing operation can be performed thereon as the cage and mandrel are driven in rotation. In either operation a slight angular disposition of the rollers relative to the axis of the mandrel and cage produces a feed movement to the rod or cylindrical element to advance them over the tool head. With this arrangement, the diameter of the cylindrical elements being burnished may vary since the rollers are moved into engagement with the surface under a predetermined pressure irrespective of the varying diameter thereof.

DESCRIPTION OF THE PREFERRED EMBODIMENTS

Figures 1, 2:
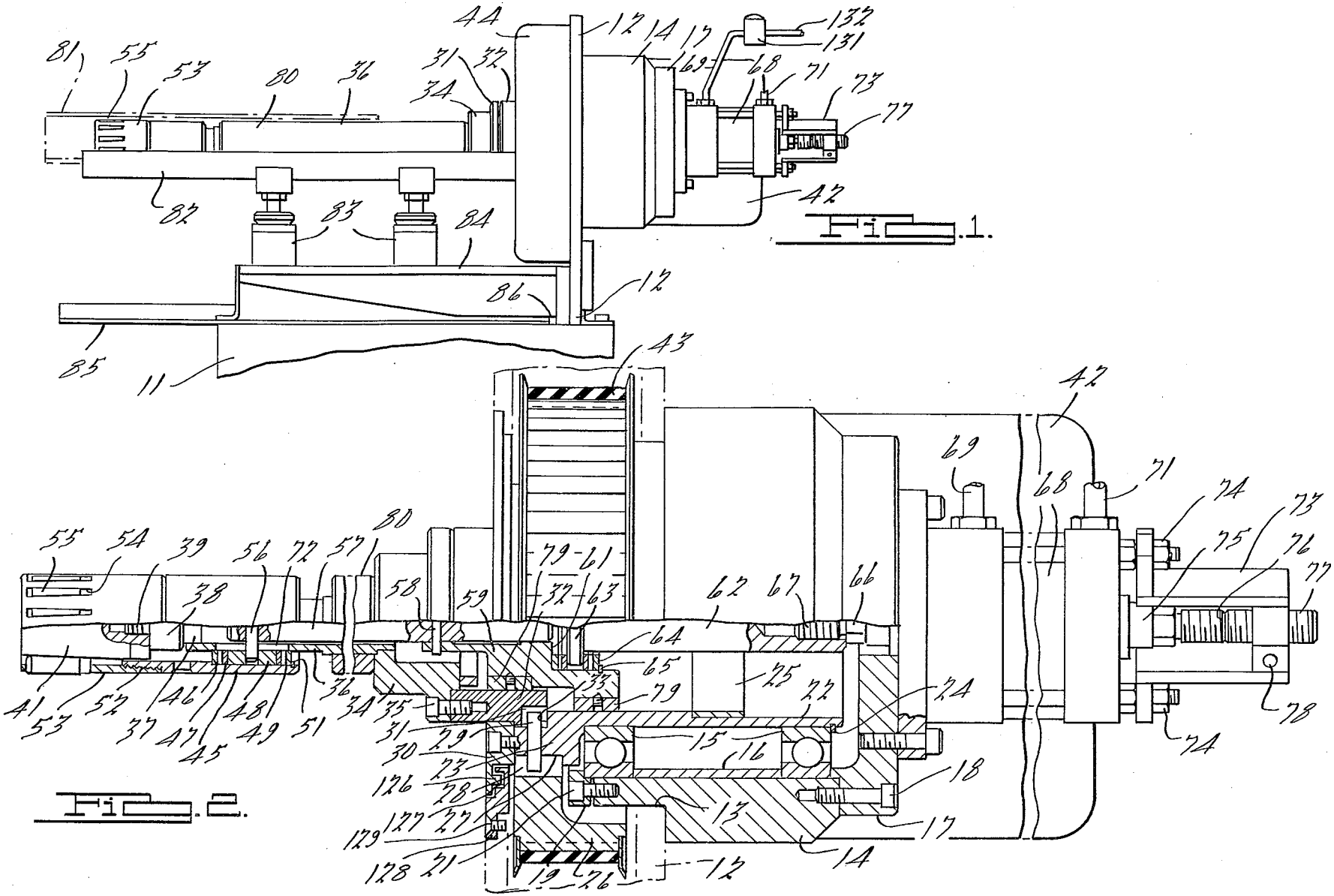
FIG. 1 is a view in side elevation of a burnishing device for interior surfaces of workpieces embodying features of the present invention.
FIG. 2 is an enlarged view of the device illustrated in FIG. 1, showing parts in section.

A base 11 supports an upright plate 12 having a central aperture 13 in which a cylindrical housing 14 is inserted and secured thereto. The housing 14 is hallow having a set of bearings 15 mounted therein, one at each end, and retained in spaced relation by a sleeve 16. A flange 17 is secured to the righthand end of the housing 14 by a plurality of screws 18 while a ring 19 is secured to the opposite end of the housing 14 by a plurality of screws 21. A sleeve 22 is supported by the inner races of the bearings 15 having a driving shoulder 23 on one end and a locking ring 24 on the opposite end for retaining the sleeve 22 in fixed relation to the inner race of the bearings 15. The end of the sleeve 22 adjacent to the ring 24 is increased in diameter for receiving a bearing sleeve 25.

A pulley 26 is mounted on the driving shoulder 23 through the engagement with the surface 27, the pulley having a slot 28 therein. A pin 29 in the shoulder 23 extends into the slot 28 and produces a drive from the pulleys therewith. The opposite end of the pin 29 extends into a recess 31 in a retainer 32 which is secured against a shoulder 33 on the driving shoulder 23 by a ring 30. The retainer 32 has a ring 34 secured forwardly thereof by a plurality of screws 35. A sleeve 36 is secured to the ring 34 with its forward end supporting the end 37 of an adapter 38. A threaded end 39 on the forward end of the adapter is screwed into a threaded aperture in the mandrel 41 which has an outer surface of truncated conical form. When the pulley rotates, the sleeve 22 and the mandrel 41 therewith.

A motor 42 is mounted on the plate 12 having a pulley (not shown) which is engaged by a belt 43 which passes around the pulley 26 to produce a drive therefor. A cover 44 is secured to the forward face of the plate 12 to encompass the pulleys and belt to hide them from view and prevent inadvertent contact therewith. A sleeve 45 has a shoulder 46 against which a bearing 47 is engaged by a spacer 48 which also engages a bearing 49 which is secured to the sleeve 45 by a lock ring 51. A shouldered threaded end 52 of the sleeve 45 has a cage 53 threaded thereon containing a plurality of tapered slots 54 in which tapered rollers 55 are retained against outward movement in engagement with the conical surface on the mandrel 41. The spacer 48 is connected by a pin 56 to the forward end of a rod 57. The opposite end of the rod 57 is secured by a pin 58 to a sleeve 59 which has a shoulder 61 at the inner end. A rod 62 has a head 63 on its forward end which is secured between a pair of thrust bearings 64 when retained against the shoulder 61 of the sleeve 59 by a locking ring 65. The rod 62 has a threaded aperture in its remote end in which a threaded end 67 of a piston rod 66 is secured. A piston on the rod 66 is mounted in a cylinder 68 to operate forwardly and backwardly a short distance in the nature of an inch and is moved to the right when fluid is introduced through a conduit 69 and to the left when fluid is introduced into a conduit 71. Air is preferably employed as the fluid although oil and other types may be utilized. The pin 56 extends through a slot 72 in the sleeve 36 to permit the forward and rearward movement of the cage 53 to retract and expand the rollers 55, respectively.

A stop bracket 73 is mounted on the outer end of the cylinder 68 by studs and nuts 74. The piston has an extending rod 75, the end 76 of which abuts the end of a set screw 77 which is adjustable inwardly and outwardly and retained in its adjusted position by a set screw 78. This controls the amount of retractive movement which occurs to the cage 53 to limit the retraction of the rollers 55 when the workpiece is to be removed so as to regulate the degree of outward movement required to the rollers 55 when moved into engagement with the internal surface of the tube to be burnished to thereby reduce the time of the work cycle. The sleeve 59 has bearing rings 79 secured thereon for engagement with the inner surface of the sleeve 22 and the retainer 32 for relative rotation therebetween. As illustrated in FIG. 1, the cage 53 has a liner 80 of substantial length to permit a tubular workpiece 81 of substantial length to have its interior surface burnished after the end of the tube is inserted over the retracted rollers 55 of the cage 53 with the motor driving the cage and mandrel in rotation.

The advancement of the piston in the cylinder 68 will expand the rollers into engagement with the inner surface of the workpiece 81 which will be burnished under a predetermined pressure provided by the air on the piston. The workpiece may be advanced automatically during the burnishing operation by providing a slight offset angular relation of the rollers to the axis of the cage 53. A trough 82 is disposed beneath the burnishing tool for supporting the workpiece 81 as it is advanced. The trough is supported on jack-like elements 83 which are adjustable to move the trough upwardly and downwardly relative to a support 84. A pan 85 is provided below the support 84 to catch the coolant from the end of the trough which passes downwardly through an opening 86 into the recirculating tank within the base 11 (not shown). After the workpiece 81 has been mounted into engagement with the ring 34, the piston within the cylinder 68 is moved inwardly to move the mandrel 41 into engagement with the workpiece which will be moved from the ends of the rollers as the burnishing operation is completed.

Figure 3:
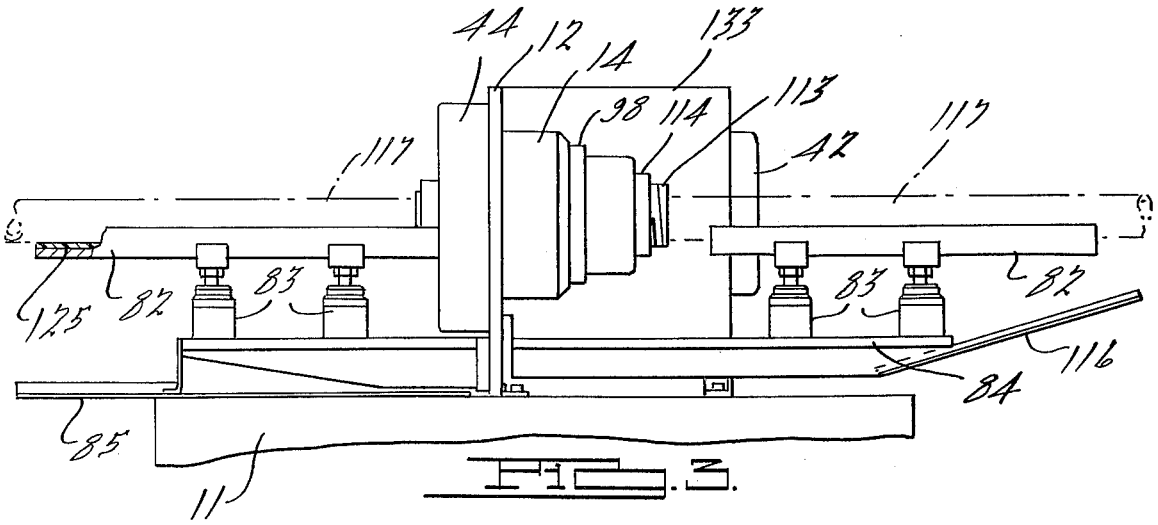
FIG. 3 is a view of structure similar to that illustrated in FIG. 1, employed for burnishing the exterior surface of workpieces.
Figure 4:
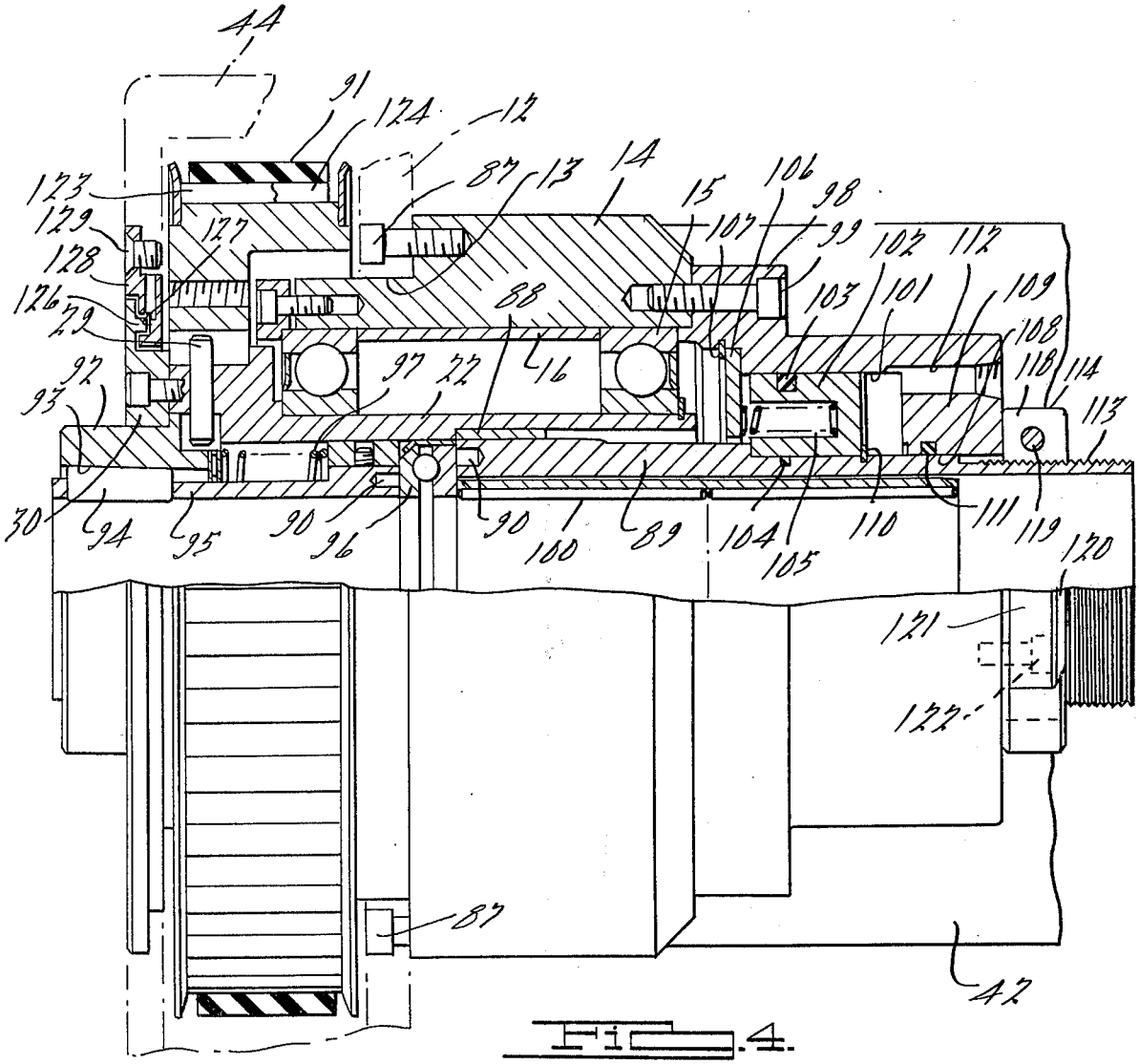
FIG. 4 is an enlarged view of the structure illustrated in FIG. 3, with parts in section.

Referring to FIGS. 3 and 4, a similar device is illustrated that wherein the plate 12 has the housing 14 secured thereto by a plurality of screws 87. The bearings 15 support the sleeve 22 for rotation with a bearing ring 88 on the interior thereof disposed in engagement with a sleeve 89 which may or may not rotate therewithin. A pulley 91 is attached to the sleeve 22 for driving a mandrel 92 by the pin 29 in a manner as pointed out hereinabove. The mandrel has a truncated conical surface 93 on the inside engaged by truncated conical rollers 94 which are secured in a cage 95, the inner end of which engages a bearing 96 which abuts the sleeve 89. This permits the mandrel 92 and cage 95 to rotate independent of the sleeve 89. When the mandrel 92, cage 85 and sleeve 89 are not to be rotated, a ring (not shown) is substituted for the bearing 96 with pins extending from opposite sides which extend into apertures 90 in the adjacent ends of the cage 95 and sleeve 89 and prevent relative rotation therebetween. A spring 97 is provided about the cage 95 for urging the cage to the right as viewed in the Figure.

The righthand end of the housing 14 has a housing 98 secured thereto by a plurality of screws 99. The housing has a cylindrical aperture 101 in which a ring-type piston 102 is mounted and sealed by an O-ring 103 on the outer surface and by an O-ring 104 on the inner surface. The piston 102 has a plurality of springs 105, eight in number, which urge the piston to the right when abutted against a washerlike plate 106 secured in position by a lock ring 107. The righthand end of the sleeve 89 has a head 109 which is sealed to the surface of the sleeve 89 by an O-ring 111. The piston 102 is secured in fixed relation to the sleeve 89 by a lock ring 110 to have the sleeve move forwardly and rearwardly with the piston. A passage 112 is provided through the head 109 of the housing 98 for the introduction of a fluid, such as air, to within the aperture 101 for moving the piston 102 forwardly therein. When air is removed from the piston, the piston and sleeve will be moved to the right by the plurality of springs 105 which permits the spring 97 to move the cage 95 along therewith and remove the pressure from the rollers 94. By using the bearing 96, the cage 95 and mandrel 92 will be rotated by the pulley 91 without rotating the sleeve 89.

The outer surface of the righthand end of the sleeve 89 is provided with a thread 113 on which a nut 114 is screwed for limiting the forward movement of the sleeve and cage and the degree of retraction of the rollers 94. The ring has a slot 118 so that it can be drawn together by a screw 119 after being adjusted on the thread 113. A rectangular block 121 is secured to the housing end 109 by screws 122 in position to have a side abut a flat area 120 on the outer wall of the ring to prevent the ring from rotating on the thread. A workpiece in the nature of a rod or sleeve is advanced into the rollers 94 when in retracted position and fluid is conducted from the passageway 112 to permit the piston 102 to be moved to the right by the springs 105 and the cage 95 with the rollers 94 moved therewith by the springs 97 to have the rollers retracted. As the cage and mandrel rotates, the work will automatically feed past the rollers if slightly offset at an angle to the axis of the mandrel. In this arrangement, the workpiece may be passed completely through the burnishing device after which the delivery of the fluid through the passgeway 112 will move the sleeve 89 and cage 95 to the left thereby permitting the rollers 94 to retract so that another workpiece may be inserted therebetween. The workpiece could be fed into the rollers while the end of one ahead thereof is being finished to thereby eliminate the retraction of the rollers.

Such an arrangement is illustrated in FIG. 3 where troughs 82 are supported at each end of the burnishing device on supporting elements 83 which are adjustable toward and away from the workpiece 117 in a manner pointed out hereinabove. Troughs 82 are mounted on the opposite end of the burnishing device for supporting the workpiece with pans 85 and 116 therebelow for collecting the coolant in a manner pointed out hereinabove. Thus, as one workpiece 117 passes from the rollers 94 the second workpiece being retained thereagainst moves within the rollers so that the operation can be continuous. The workpieces ride upon replaceable strips 125 of Nylon, teflon or other low friction material to provide support therefor with the expenditure of a minimum amount of friction. The ring 30 has an inwardly extending annular flange 126 which extends into an annular recess 127 of a ring 128 which is secured to the cover 44 by screws 129. The tortous passageway between the mating faces of the rings 30 and 128 prevents dust and grime from passing therethrough. In FIG. 2, the belt 43 and pulley 26 have flat faces in engagement with each other. In FIG. 4, the pulley 91 has its surface interrupted with laterally disposed slots 123 in which teeth 124 on the inner face of the belt engage to produce a nonslip relation therebetween.

To provide uniform burnishing throughout the length of the workpiece, air to the conduit 69 is passed through a filter, regulator and lubricating device 131 to which the supply airline 132 is connected. When the rollers engage a point within the interior of the workpiece which is of less diameter than the standard diameter of the workpiece, pressure will increase on the rollers and on the air in the line 69 which is relieved and retained constant by the regulator valve of the device 131. With this arrangement, a substantially constant pressure of air is at all times present on the side of the piston to which the air through the conduit 69 impinges to apply pressure to the rollers. This prevents the overloading of the tool and possible damage thereto while producing the desired finish to all parts of the surface of the workpiece. This same device is employed in the same manner on a tool which operates on the external surface of a workpiece for maintaining equal pressures at all times during the burnishing operation. In FIG. 3, it will be noted that a plate 133 is welded or otherwise secured at right angle to the plate 12 and support 84 to strengthen the assembly.

I claim:

1. In a burnishing tool, a support, a housing on said support, a spindle, bearing means supporting said spindle within said housing for rotation, drive means for rotating said spindle, a burnishing head on the forward end of said spindle having a mandrel and a slotted cage with truncated rollers within the slots, a cylinder, a piston in said cylinder for relatively moving said mandrel and cage to move the rollers into engagement with the surface of a workpiece for applying a predetermined pressure irrespective of variations of diameter of the workpiece, and means for retracting the rollers from engagement with the workpiece.

2. In a burnishing tool as recited in claim 1, wherein means is provided for limiting the amount of retractive movement produced to the rollers.

3. In a burnishing tool as recited in claim 2, wherein said limiting means is adjustable for regulating the amount of retractive movement provided to the rollers.

4. In a burnishing tool as recited in claim 2, wherein the drive means embodies a flat pulley on said spindle, a motor on said support, a flat pulley on said motor, and a flat belt between said pulleys.

5. In a burnishing tool as recited in claim 4, wherein a side face of the spindle pulley is recessed for receiving the adjacent portion of the housing and bearing means in overhanging relation therewith.

6. In a burnishing tool as recited in claim 5, wherein said pulley surface has laterally disposed slots forming teeth-like protuberance therebetween, and wherein the inner face of the belt has teeth thereon to provide a positive drive therebetween.

7. In a burnishing tool as recited in claim 1, therein said support has vertically adjustable elements thereon, and a trough supported on said adjustable elements which extends beyond said burnishing head for supporting a workpiece.

8. In a burnishing tool as recited in claim 1, wherein said spindle is hollow, and wherein said rollers are adjusted inwardly to operate on the outer surface of a workpiece which may be passed entirely through said spindle.

9. In a burnishing tool as recited in claim 8, wherein said support has vertically adjustable elements each side thereof, and troughs supported by said adjustable elements beneath the forward and rear portions of said spindle in position to support the workpiece either side thereof.

10. In a burnishing tool as recited in claim 7, wherein replaceable bearing elements are provided on the inside of the trough for engagement with the workpiece.

* * * * *